US008025176B2

(12) United States Patent
Little et al.

(10) Patent No.: US 8,025,176 B2
(45) Date of Patent: Sep. 27, 2011

(54) PLASTIC CONTAINER INCLUDING A GRIP FEATURE

(75) Inventors: J. Steven Little, Wadsworth, OH (US); James J. Miller, Barberton, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 693 days.

(21) Appl. No.: 11/430,610

(22) Filed: May 9, 2006

(65) Prior Publication Data

US 2006/0207963 A1 Sep. 21, 2006

Related U.S. Application Data

(63) Continuation-in-part of application No. 29/217,522, filed on Nov. 18, 2004, now Pat. No. Des. 530,617.

(51) Int. Cl.
*B65D 8/04* (2006.01)
*B65D 90/02* (2006.01)

(52) U.S. Cl. ..... 220/675; 220/570; 220/659; 220/755; 220/771; 220/DIG. 12; 220/DIG. 13; 220/DIG. 14; 215/384

(58) Field of Classification Search ..... 215/384; 220/675, 771, 495.02, 659, 695–698, 733, 220/735, 726, 914, DIG. 12–DIG. 14, 570, 220/571.1, 736, 755; D9/542, 543, 443, D9/530, 531; D7/318, 319, 691
See application file for complete search history.

(56) References Cited

U.S. PATENT DOCUMENTS 1,599,967 A 9/1926 Johnson
D88,111 S * 10/1932 Scurlock ..... D7/612
1,946,149 A * 2/1934 Churchill ..... 205/201
D160,516 S * 10/1950 Marsh ..... D7/318
2,610,490 A * 9/1952 Tupper ..... 222/210
D171,647 S * 3/1954 Hills ..... D9/523
D181,621 S * 12/1957 Blod ..... D7/317
D185,736 S * 7/1959 Cole ..... D7/612
D189,696 S * 1/1961 Nagel ..... D7/619.1
D192,535 S * 4/1962 Laudano ..... D9/543
3,049,014 A * 8/1962 Aue ..... 73/426
D195,064 S * 4/1963 Northbrook ..... D9/523
D195,600 S * 7/1963 Neyman ..... D9/523
D196,076 S * 8/1963 Schnur ..... D9/528
D196,984 S * 11/1963 Platte ..... D9/528
D197,581 S * 2/1964 Trombly et al. ..... D9/528
D198,407 S 6/1964 Busch
D199,037 S * 9/1964 Jackson et al. ..... D7/691
D199,505 S * 11/1964 Swett et al. ..... D7/629
D200,260 S * 2/1965 Craig et al. ..... D9/520
3,194,423 A 7/1965 Mailoff (Continued)

OTHER PUBLICATIONS

International Searching Authority/United States; International Search Report and Written Opinion for PCT/US07/02441, mailed Dec. 4, 2007.

(Continued)

*Primary Examiner* — J. Gregory Pickett
*Assistant Examiner* — Ned A Walker
(74) *Attorney, Agent, or Firm* — Dykema Gossett PLLC

(57) ABSTRACT

A blow molded, hollow plastic container including two opposed, relatively longer sidewall portions which alternate with two opposed, relatively shorter sidewall portions. A first of the relatively shorter sidewall portions includes a grip area, and the opposed second relatively shorter sidewall portion includes a pour area.

16 Claims, 3 Drawing Sheets

U.S. PATENT DOCUMENTS 3,232,495 A * 2/1966 Schueider ..... 222/209
D209,018 S * 10/1967 Holtz ..... D9/543
3,346,271 A * 10/1967 Parsons ..... 280/33.998
3,881,471 A * 5/1975 Grube ..... 601/158
D237,143 S * 10/1975 Bjork ..... D9/425
4,157,762 A * 6/1979 Robinson ..... 220/669
D266,095 S * 9/1982 Hara ..... D18/43
D269,315 S * 6/1983 Conti ..... D7/591
D272,552 S * 2/1984 Clanton ..... D21/532
D272,991 S * 3/1984 Thompson ..... D9/529
D274,778 S * 7/1984 Reece et al. ..... D7/691
D276,400 S * 11/1984 Daenen et al. ..... D7/629
D279,763 S * 7/1985 Hestehave et al. ..... D9/528
D283,196 S * 4/1986 Hasse ..... D8/10
D284,728 S * 7/1986 Trivison ..... D7/629
D293,652 S * 1/1988 Peters ..... D23/211.1
D293,653 S * 1/1988 Peters ..... D9/528
4,869,385 A * 9/1989 Blinsinger ..... 220/4.01
D306,324 S * 2/1990 Dykes ..... D21/472
D307,549 S * 5/1990 Beaver et al. ..... D9/528
D307,550 S * 5/1990 Beaver et al. ..... D9/528
4,927,046 A * 5/1990 Armstrong ..... 220/697
D308,336 S * 6/1990 Delbanco ..... D9/572
D309,420 S * 7/1990 Beaver ..... D9/528
D314,139 S * 1/1991 Ambasz ..... D9/523
D323,115 S * 1/1992 Kelsey ..... D9/423
5,092,474 A * 3/1992 Leigner ..... 215/381
5,103,988 A 4/1992 Reil et al.
5,165,558 A * 11/1992 Cargile ..... 215/391
D334,713 S * 4/1993 Segati ..... D9/543
5,261,544 A * 11/1993 Weaver, Jr. ..... 215/384
D343,093 S * 1/1994 Sabin et al. ..... D7/612
D350,876 S * 9/1994 VanValkenburg et al. ..... D7/612
5,356,027 A * 10/1994 Craft et al. ..... 220/840
5,358,138 A * 10/1994 Karwoski ..... 220/495.11
5,390,817 A 2/1995 Rosen
D356,368 S * 3/1995 Kunze ..... D23/366
D357,867 S * 5/1995 Beier-Rosetti ..... D9/523
5,419,453 A * 5/1995 Lochridge ..... 220/495.06
D360,334 S * 7/1995 Garza, Jr. ..... D7/318
D370,421 S * 6/1996 Tucker ..... D10/46.3
D370,850 S 6/1996 Beaver
5,549,214 A * 8/1996 Harris ..... 220/819
D378,058 S 2/1997 Meisner et al.
5,665,224 A * 9/1997 Levene et al. ..... 210/85
D388,577 S * 12/1997 Rehrig et al. ..... D34/5
D389,067 S * 1/1998 Lown ..... D9/543
D396,808 S * 8/1998 Maria Camps et al. ..... D9/527
D408,739 S * 4/1999 Satterfield et al. ..... D9/520
D409,090 S * 5/1999 Lai et al. ..... D9/523
5,908,136 A * 6/1999 Mrak ..... 220/756
5,941,410 A * 8/1999 Mangano ..... 220/735
D419,884 S * 2/2000 Zimmer et al. ..... D9/523
D425,381 S * 5/2000 Denham et al. ..... D7/691
6,059,153 A 5/2000 Olson et al.
D428,817 S * 8/2000 Olson et al. ..... D9/531
D431,470 S 10/2000 Henderson
6,131,758 A * 10/2000 Callahan et al. ..... 220/314
6,164,474 A * 12/2000 Cheng et al. ..... 215/384
6,210,032 B1 4/2001 Murphy
D443,508 S * 6/2001 Braaten et al. ..... D9/734
D444,067 S * 6/2001 Goettner ..... D9/525
D444,679 S * 7/2001 Lillelund et al. ..... D7/629
D446,346 S * 8/2001 Angeletta ..... D28/7
D446,882 S * 8/2001 Angeletta ..... D28/7
6,279,788 B1 * 8/2001 Lillelund et al. ..... 222/481
D448,671 S * 10/2001 Gans et al. ..... D9/527
6,401,959 B1 * 6/2002 Dreano ..... 220/476
D462,012 S * 8/2002 Manderfield, Jr. ..... D9/530
D462,838 S * 9/2002 Van Landingham ..... D3/304
6,446,830 B1 * 9/2002 Ocic ..... 220/771
D471,459 S * 3/2003 Denham et al. ..... D9/524
D473,140 S * 4/2003 Gilliam et al. ..... D9/428
D473,762 S * 4/2003 Kerr ..... D7/688
D473,794 S * 4/2003 Ouillette et al. ..... D9/523
D475,928 S * 6/2003 Ferguson et al. ..... D9/526
D480,312 S * 10/2003 Mungur et al. ..... D9/537
D482,973 S * 12/2003 Nottingham et al. ..... D9/531
D482,974 S * 12/2003 Nottingham et al. ..... D9/531
6,708,838 B2 * 3/2004 Bergman et al. ..... 220/757
D490,318 S * 5/2004 Ferguson ..... D9/526
D490,713 S * 6/2004 Ferguson ..... D9/526
D493,035 S * 7/2004 Bergman ..... D3/304
6,761,283 B1 * 7/2004 Gilliam et al. ..... 220/837
D496,863 S * 10/2004 Aldrey et al. ..... D9/523
6,843,389 B2 * 1/2005 Kasting et al. ..... 222/111
D505,331 S * 5/2005 Lane et al. ..... D9/542
6,889,866 B2 5/2005 Gilliam et al.
D506,346 S * 6/2005 Matsumoto et al. ..... D7/317
6,964,359 B1 * 11/2005 Darr et al. ..... 222/570
D513,702 S * 1/2006 Ferguson et al. ..... D9/528
6,991,829 B2 * 1/2006 Bergman ..... 427/429
6,997,354 B2 * 2/2006 Kasting et al. ..... 222/111
7,040,509 B2 * 5/2006 McLelland et al. ..... 222/109
D528,007 S 9/2006 De Niverville et al.
D530,617 S * 10/2006 Little et al. ..... D9/543
7,150,380 B2 * 12/2006 Hoepner et al. ..... 222/480
D535,530 S * 1/2007 Clement ..... D7/629
7,175,051 B2 * 2/2007 McLelland et al. ..... 222/109
7,191,913 B2 * 3/2007 Byrne ..... 220/570
D543,466 S * 5/2007 Little et al. ..... D9/543
D543,467 S * 5/2007 Dorn ..... D9/543
7,216,779 B2 * 5/2007 Kasting et al. ..... 222/111
D543,853 S * 6/2007 Little et al. ..... D9/523
D543,860 S * 6/2007 Pacente et al. ..... D9/543
D543,862 S * 6/2007 Miller et al. ..... D9/543
D549,913 S * 8/2007 Bergman ..... D32/53
D558,393 S * 12/2007 Angeletta ..... D28/7
D559,029 S * 1/2008 Gonzalez et al. ..... D7/318
D570,222 S * 6/2008 Flanagan-Kent et al. ..... D9/531
D582,289 S * 12/2008 Kissinger et al. ..... D9/543
D585,748 S * 2/2009 Flanagan-Kent et al. ..... D9/516
7,530,478 B2 * 5/2009 Blomdahl et al. ..... 222/556
D597,407 S * 8/2009 Maddy ..... D9/523
7,644,829 B2 * 1/2010 Little et al. ..... 215/384
7,644,835 B2 * 1/2010 Bergman ..... 220/736
2002/0036206 A1 * 3/2002 Bergman et al. ..... 220/754
2002/0195471 A1 * 12/2002 Nottingham et al. ..... 222/570
2003/0062365 A1 * 4/2003 Krueger ..... 220/4.24
2004/0011811 A1 * 1/2004 McLelland et al. ..... 222/109
2004/0087883 A1 * 5/2004 Berger ..... 601/167
2004/0099109 A1 * 5/2004 Dunlap et al. ..... 83/48
2004/0118861 A1 * 6/2004 Bergman et al. ..... 220/756
2004/0206761 A1 * 10/2004 Frantz ..... 220/570
2004/0238547 A1 * 12/2004 Tyra et al. ..... 220/675
2005/0023293 A1 2/2005 Kasting et al.
2005/0161462 A1 * 7/2005 Bergman ..... 220/757
2005/0163882 A1 * 7/2005 Dunlap et al. ..... 425/289
2005/0173442 A1 * 8/2005 Gilliam et al. ..... 220/675
2005/0181159 A1 * 8/2005 Dunlap et al. ..... 428/35.7
2006/0021984 A1 * 2/2006 Nottingham et al. ..... 220/288
2006/0156811 A1 7/2006 Borowski et al.
2006/0243732 A1 * 11/2006 Bergman ..... 220/757
2007/0187420 A1 * 8/2007 Gruskin et al. ..... 220/771
2008/0093332 A1 * 4/2008 Little et al. ..... 215/384

OTHER PUBLICATIONS

International Preliminary Examining Authority; International Preliminary Report on Patentability for PCT/US07/02441, mailed Oct. 21, 2008.

* cited by examiner

PLASTIC CONTAINER INCLUDING A GRIP FEATURE

CROSS-REFERENCE TO RELATED APPLICATIONS

This application is a continuation-in-part of U.S. patent application Ser. No. 29/217,522, filed Nov. 18, 2004 now U.S. Pat. No. D, 530,617.

BACKGROUND OF THE INVENTION

Plastic containers are widely used commercially for a variety of products. It is highly desirable to provide a plastic container which facilitates ease of product dispensing, while at the same time providing a container with an improved configuration which enables more convenient handling in the product preparation and filling cycles and by the consumer in use. It would also be advantageous to provide a light weight container which would enable rapid cycle times in the container preparation and filling procedure while facilitating product use, especially product dispensing from the container.

It is, therefore, an object of the present invention to provide an improved plastic container which facilitates product dispensing and which enables ease of use by the consumer.

It is a further object of the present invention to provide an improved plastic container as aforesaid with an improved container configuration which enables convenient handling in the product preparation and filling cycles and by the consumer in use.

Further objects of the present invention will appear hereinbelow.

SUMMARY OF THE PRESENT INVENTION

In accordance with the present invention the foregoing objects and advantages are readily obtained.

The improved plastic container of the present invention comprises: a blow molded, hollow plastic container having a generally oval base, a cylindrical sidewall extending upwardly from the base, and a neck finish extending upwardly from the sidewall and having a generally oval opening to the inside of the container; wherein said container includes two opposed, relatively longer sidewall portions which alternate with two opposed, relatively shorter sidewall portions; and with a first of said relatively shorter sidewall portions being relatively longer than a second of said relatively shorter sidewall portions, and with said first relatively shorter sidewall portions including an integral grip area thereon, as a hand or finger grip area.

The neck finish of said container advantageously includes two opposed, relatively longer side portions which extend upwardly from said longer sidewall portions and two opposed, relatively shorter side portions which extend upwardly from said shorter sidewall portions. A first of said relatively shorter neck finish side portions is desirably relatively longer than a second of said relatively shorter neck finish side portions and extends upwardly from said first relatively shorter sidewall portions.

Preferably, the circumference of the oval opening is smaller than the circumference of the oval base. Preferably also the grip area extends over a portion of said relatively longer sidewall portions, and said second relatively shorter sidewall portion includes a recessed pour area beneath the second of said relatively shorter neck finish side portion.

While the plastic container can be readily used with any plastic material, it is particularly suitable for use with polyethylene terephthalate.

Further features and advantages of the present invention will appear hereinbelow.

BRIEF DESCRIPTION OF THE DRAWINGS

The present invention will be more readily understandable from a consideration of the following illustrative drawings, wherein.

DETAILED DESCRIPTION OF PREFERRED EMBODIMENTS

Figure 1:
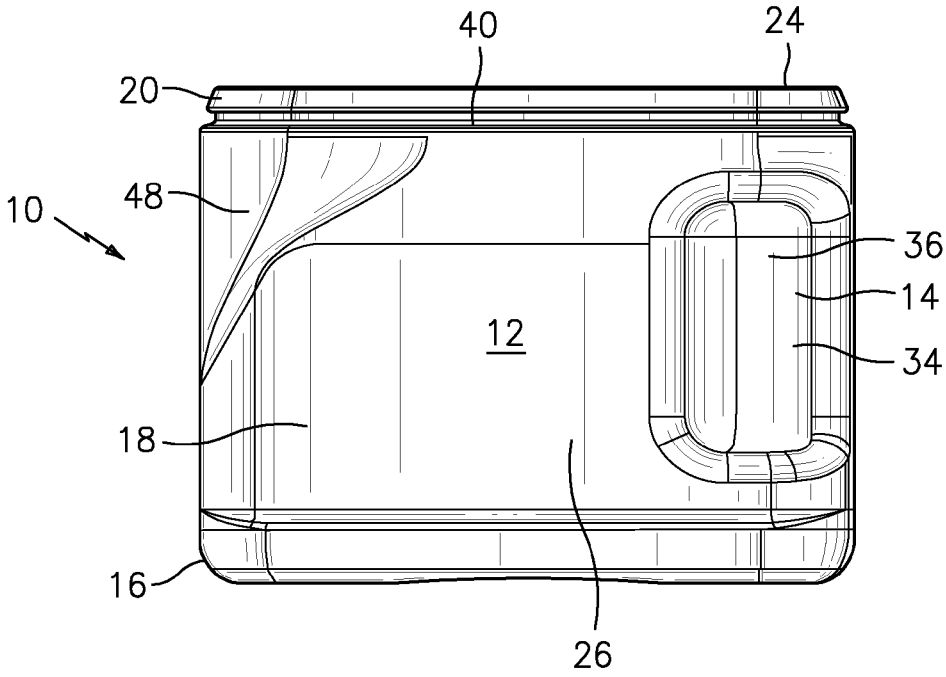
FIG. 1 is a right side view of one embodiment of the plastic container of the present invention.
Figure 2:
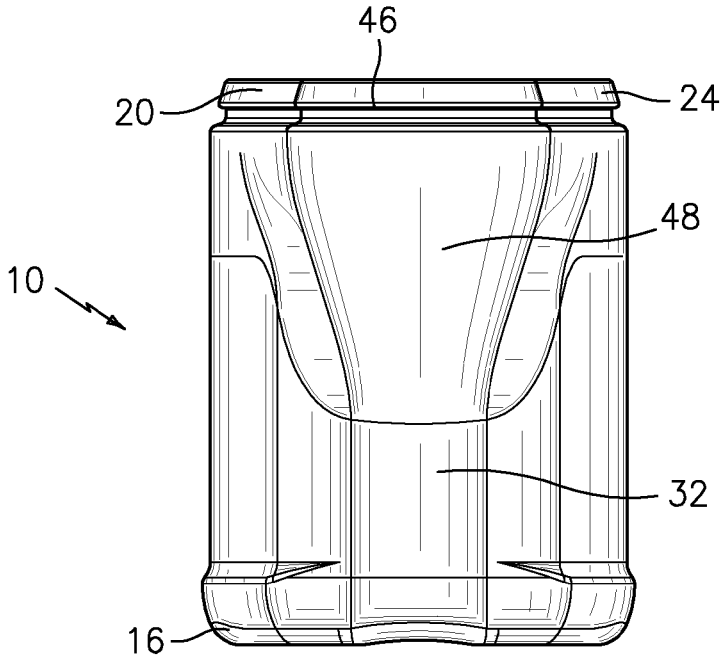
FIG. 2 is a front elevational view thereof.
Figure 3:
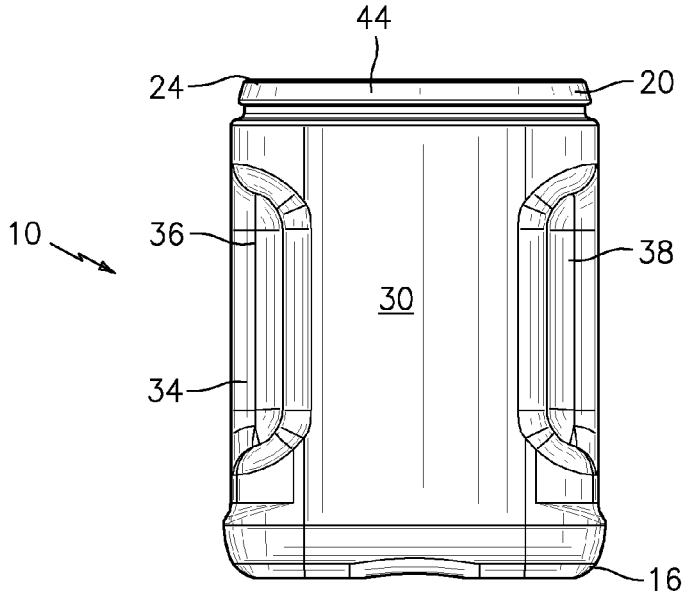
FIG. 3 is a rear elevational view thereof.
Figure 4:
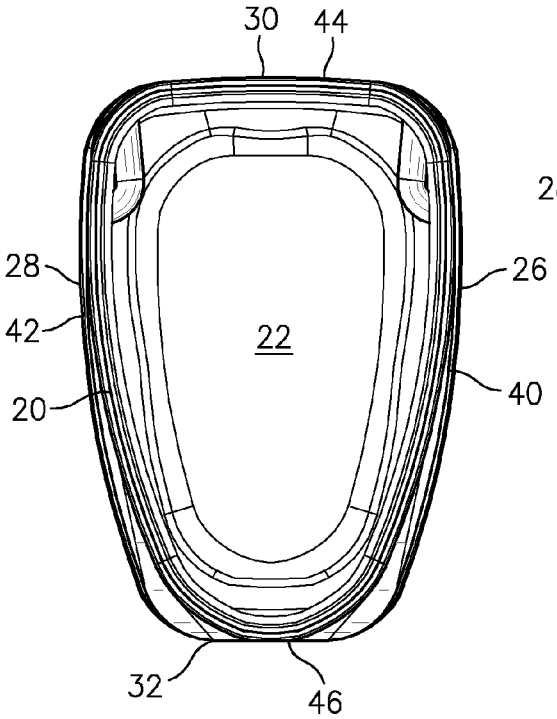
FIG. 4 is a top plan view thereof.
Figure 5:
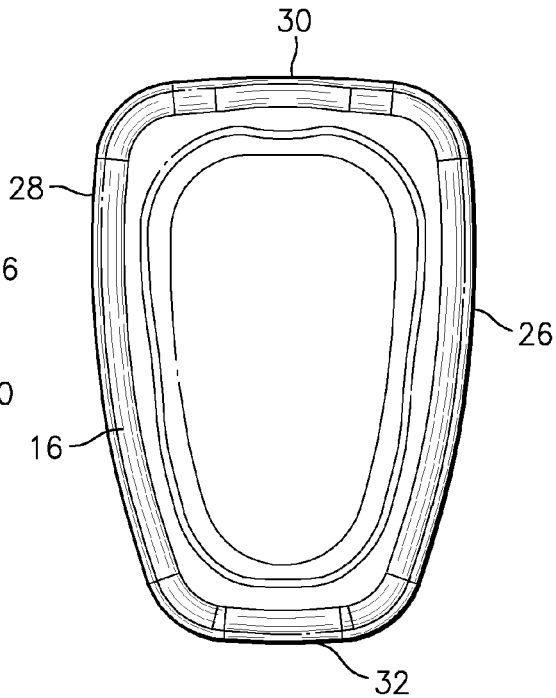
FIG. 5 is a bottom plan view thereof.
Figure 6:
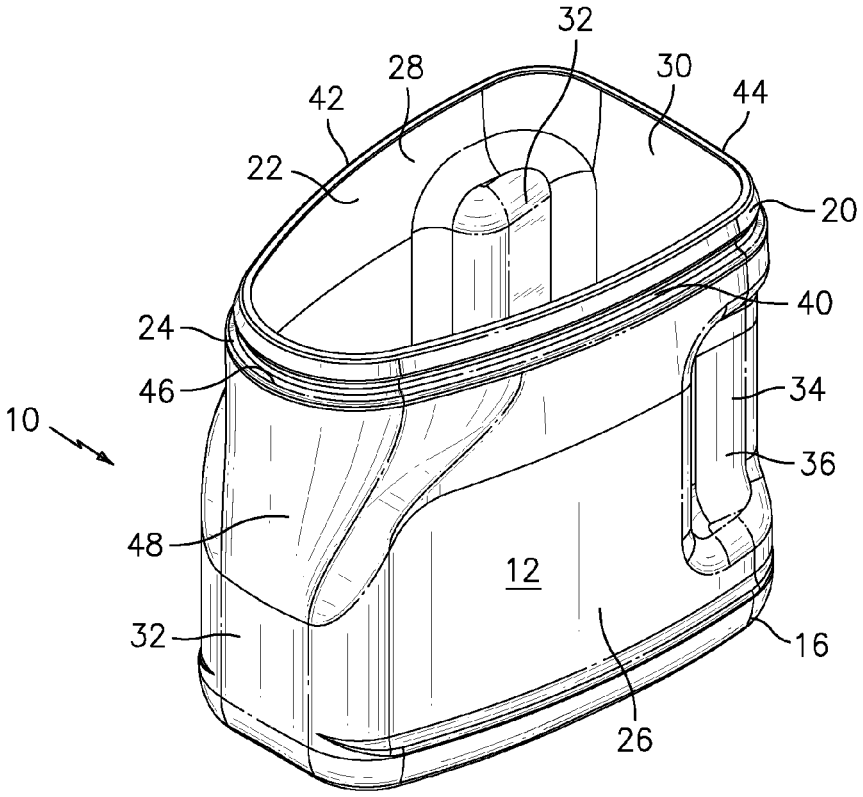
FIG. 6 is a perspective view thereof showing the front, right side and top thereof.
Figure 7:
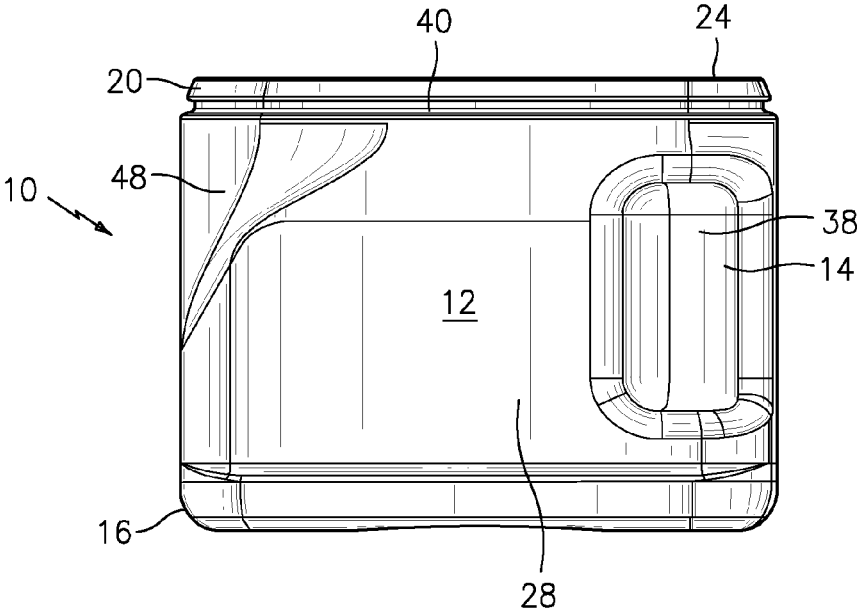
FIG. 7 is a left side view thereof.

Referring to the drawings, FIGS. 1-7 show one embodiment of the plastic container of the present invention.

FIG. 1 shows plastic container 10 of the present invention with container portion 12 and integral grip area 14. The container is a hollow, blow molded plastic container having a lower supporting base 16, a sidewall 18 extending upwardly from the base, and a neck finish 20 extending upwardly from the sidewall and having an opening 22 to the inside of the container. As can be clearly seen in FIGS. 4-6, the plastic container 10 has a generally oval base 16 and a generally oval opening 22 to the inside of the container.

The containers of the present invention are preferably made of a pliable, deformable, synthetic plastic material, such as for example, polyethylene, polypropylene, or polyethylene terephthalate (PET), or other plastic material, although PET is generally used.

The particular neck portion 22 shown in the embodiment of FIGS. 1-7 includes an upper flange portion 24 for a snap-on closure and/or a foil closure (not shown). However, other type neck finishes can be readily employed, as a threaded section to accommodate a screw-on closure. Also, the outer extent of the upper neck finish in the embodiment shown extends inwardly of the sidewall, which is preferred.

Plastic container 10 includes two, opposed first and second relatively larger sidewall portions 26, 28, respectively, which alternate with two opposed, first and second relatively shorter sidewall portions 30, 32, respectively. The first relatively shorter sidewall portion 30 is relatively longer than the second of said relatively shorter sidewall portion 32. In addition, grip area 34 is included on the first relatively shorter sidewall portion 30. The grip area 34 is a hand or finger grip area which includes first and second spaced apart recessed areas 36 and 38, respectively, each of which extends onto the adjacent relatively longer sidewall portions. That is, first recessed area 36 extends onto first relatively longer sidewall portion 26 and second recessed area 38 extends onto second relatively longer sidewall portion 28. Thus, a convenient hand or finger grip area is provided which facilitates a strong and firm hold onto the container by the user.

Similarly, the neck finish area 20 includes two, opposed first and second relatively longer side portions 40, 42, respectively, which extend upwardly from the longer sidewall portions 26, 28, respectively, and two opposed first and second relatively shorter side portions 44, 46, respectively, which extend upwardly from the shorter sidewall portions 30, 32, respectively. The first relatively shorter neck finish side portion 44 is relatively longer than the second relatively shorter neck finish side portion 46 to provide a convenient dispensing or pour channel at the shorter neck finish side portion 46. The dispensing function is enhanced by a recessed dispensing or pour area 48 beneath the second shorter neck finish side portion 46 on the second shorter sidewall portion 32. The dispensing function is further enhanced by providing that the circumference of the neck finish opening 22 is smaller than the circumference of the base 16. In addition, the corners of the second shorter neck finish side portions have a round circumference to further facilitate dispensing.

Thus, it can be seen that the plastic container of the present invention is extremely convenient for handling and dispensing contents. The grip area is opposed to the dispensing area and the sidewall and neck finish features make the container quite easy to use. An additional advantage of the present container is that the container is readily stackable.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container which comprises:

a blow molded plastic body having a generally rounded trapezoidal-shaped base, a generally rounded trapezoidal-shaped sidewall extending upwardly from the base, and a neck finish extending upwardly from the sidewall and having a generally rounded trapezoidal-shaped opening to a container interior;

wherein said sidewall includes two opposed, relatively longer sidewall portions which alternate with two opposed, relatively shorter sidewall portions; said neck finish includes two opposed relatively longer neck finish side portions which extend upwardly from said longer sidewall portions, and two opposed relatively shorter first and second neck finish side portions which extend upwardly from said shorter sidewall portions, the first relatively shorter neck finish side portion is relatively longer than the second relatively shorter neck finish side portion;

a first of said relatively shorter sidewall portions being relatively longer than a second of said relatively shorter sidewall portions, with said first relatively shorter sidewall portion including:

a height extending between the base and the neck finish, and an integral hand or finger grip area including two spaced apart grip area recesses extending a vertical distance that is greater than one-half of the height of the first relatively shorter sidewall portion, and a first of said grip area recesses extends over a portion of a first of said longer sidewall portions that is adjacent to the first grip area recess; and, wherein a first circumference of the opening is smaller than a second circumference of the base, and a total length of the first longer sidewall portion is greater than the height of the first relatively shorter sidewall portion.

2. The plastic container according to claim 1, wherein an outer extent of the neck finish extends inwardly of the sidewall.

3. The plastic container according to claim 1, wherein the neck finish includes a flange portion for a snap-on closure.

4. The plastic container according to claim 1, for holding and dispensing contents.

5. The plastic container according to claim 1, wherein the plastic container is a single one-piece, unitary molded container.

6. The plastic container according to claim 1, wherein the two opposed relatively longer sidewall portions are generally angled with respect to one another.

7. The plastic container according to claim 1, wherein the two opposed relatively longer neck finish side portions are generally angled with respect to one another.

8. The plastic container according to claim 1, wherein a first perimeter of the opening is similarly shaped to a second perimeter of the sidewall.

9. The plastic container according to claim 1, wherein a first outer edge of the relatively shorter second neck finish side portion outwardly extends a first distance and a second outer edge of the shorter sidewall portion provided vertically below the relatively shorter second neck finish side portion outwardly extends a second distance, wherein the first distance is substantially equal to the second distance.

10. A single one-piece, unitary molded plastic container comprising:

a generally rounded trapezoidal-shaped base;

a generally rounded trapezoidal-shaped sidewall extending upwardly from the base; and, a neck finish extending upwardly from the sidewall and having a generally rounded trapezoidal-shaped opening to a container interior;

wherein the sidewall includes two opposed, relatively longer sidewall portions which alternate with two opposed, relatively shorter sidewall portions; the neck finish includes two opposed relatively longer neck finish side portions which extend upwardly from the longer sidewall portions, and two opposed relatively shorter first and second neck finish side portions which extend upwardly from the shorter sidewall portions, the first relatively shorter neck finish side portion is relatively longer than the second relatively shorter neck finish side portion; and a first of said relatively shorter sidewall portions being relatively longer than a second of said relatively shorter sidewall portions, with said first relatively shorter sidewall portion including:

a height extending between the base and the neck finish, and an integral hand or finger grip area including two spaced apart grip area recesses extending a vertical distance that is greater than one-half of the height of the first relatively shorter sidewall portion, and a first of said grip area recesses extends over a portion of a first of said longer sidewall portions that is adjacent to the first grip area recess; and, wherein a first circumference of the opening is smaller than a second circumference of the base, and a total length of the first longer sidewall portion is greater than the height of the first relatively shorter sidewall portion.

11. The single one-piece, unitary molded plastic container according to claim 10, wherein the two opposed relatively longer sidewall portions are generally angled with respect to one another; and the two opposed relatively longer neck finish side portions are generally angled with respect to one another.

12. The single one-piece, unitary molded plastic container according to claim 10, wherein the opening and the sidewall have perimeters that are similar in shape.

13. A single one-piece, unitary molded plastic container comprising:

a generally rounded trapezoidal-shaped base;

a generally rounded trapezoidal-shaped sidewall extending upwardly from the base; and a neck finish extending upwardly from the sidewall and having a generally rounded trapezoidal-shaped opening to a container interior;

wherein the sidewall includes two opposed, relatively longer sidewall portions which alternate with two opposed, relatively shorter sidewall portions; the neck finish includes two opposed relatively longer neck finish side portions which extend upwardly from the longer sidewall portions, and two opposed relatively shorter first and second neck finish side portions which extend upwardly from the shorter sidewall portions, the first relatively shorter neck finish side portions is relatively longer than the second relatively shorter neck finish side portion;

wherein a first of the relatively shorter sidewall portions is relatively longer than a second of the relatively shorter sidewall portions, the first relatively shorter sidewall portion includes:

an integral hand or finger grip area, the grip area extends over a portion of the relatively longer sidewall portions, the grip area includes two spaced apart recess grip areas that each extend over a portion of the adjacent longer sidewall portions;

wherein the second relatively shorter sidewall portion includes:

a height extending between the base and the neck finish, and a pour area recess beneath the second relatively shorter neck finish side portion, wherein the pour area recess longitudinally extends along a majority of the height of the second relatively shorter sidewall portion; and, wherein a total length of a first of said longer sidewall portions is greater than the height of the second relatively shorter sidewall portion.

14. The single one-piece, unitary molded plastic container according to claim 13, wherein the second relatively shorter sidewall portion includes a recessed pour area beneath the second relatively shorter neck finish side portion.

15. The single one-piece, unitary molded plastic container according to claim 13, wherein the integral hand or finger grip area extends a distance in the upward direction that is greater than one-half the total vertical height of the container.

16. The single one-piece, unitary molded plastic container according to claim 13, wherein an outer edge of the relatively shorter second neck finish side portion extends substantially to the same outward extent as an outer edge of the shorter sidewall portion provided vertically below the relatively shorter second neck finish side portion.

* * * * *